US006661628B2

(12) United States Patent
Bernard et al.

(10) Patent No.: US 6,661,628 B2
(45) **Date of Patent: *Dec. 9, 2003**

(54) METHOD FOR INTERRUPTING A CURRENT-CARRYING PATH

(75) Inventors: David J. Bernard, Newbury Park, CA (US); Paul T. Nolden, Racine, WI (US); Edward A. Mallonen, New Berlin, WI (US); Mark A. Clayton, Camarillo, CA (US)

(73) Assignee: Rockwell Automation Technologies, Inc., Mayfield Heights, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/409,126

(22) Filed: Sep. 30, 1999

(65) Prior Publication Data

US 2002/0012214 A1 Jan. 31, 2002

Related U.S. Application Data

(63) Continuation-in-part of application No. 09/219,726, filed on Dec. 22, 1998.

(51) Int. Cl.[7] ..... H01H 9/30
(52) U.S. Cl. ..... 361/13
(58) Field of Search ..... 361/4, 5, 8, 9, 361/13, 14, 106; 335/35–38, 41, 208; 218/34, 37, 38, 40, 155–158

(56) References Cited

U.S. PATENT DOCUMENTS

| | | | | |
|---|---|---|---|---|
| 4,005,340 A | * | 1/1977 | Hartel | 361/2 |
| 5,164,693 A | | 11/1992 | Yokoyama et al. | 335/14 |
| 5,166,758 A | | 11/1992 | Ovshinsky et al. | 257/3 |
| 5,539,370 A | | 7/1996 | Arnold | 337/8 |
| 5,587,861 A | | 12/1996 | Wieloch et al. | 361/14 |

(List continued on next page.)

OTHER PUBLICATIONS

R. Stumpler, G. Maidorn and J. Rhyner; Fast Current Limitation by Conducting Polymer Composites; pp. 6786–6794; May 15, 1997; Journal of Applied Physics.

(List continued on next page.)

*Primary Examiner*—Ronald W. Leja
(74) *Attorney, Agent, or Firm*—Patrick S. Yoder; Alexander M. Gerasimow; William R. Walbrun

(57) ABSTRACT

A method for interrupting current is provided wherein substantially all current is conveyed through a first current carrying path in a circuit interrupter. A movable element is displaced for interruption of the current, and current is directed through both the first current carrying path and a second current carrying path in parallel with the first path The second current carrying path includes at least one variable or controllable resistance element. Both current carrying paths conduct current during interruption, with resistance of the paths driving the current to a null level. Current through the first current carrying path may be terminated prior to current through the second path. The variable resistance element draws current into the second current carrying path once an arc in the first path reaches a resistance sufficient to transition a portion of the current to both paths.

24 Claims, 7 Drawing Sheets

U.S. PATENT DOCUMENTS

| | | | | |
|---|---|---|---|---|
| 5,614,881 | A | 3/1997 | Duggal et al. | 338/22 |
| 5,629,658 | A | 5/1997 | Chen | 335/201 |
| 5,667,711 | A | 9/1997 | Mody et al. | 219/505 |
| 5,847,630 | A | 12/1998 | Arnold et al. | 335/35 |
| 5,859,578 | A | 1/1999 | Arnold | 337/110 |
| 5,877,467 | A | 3/1999 | Arnold et al. | 218/148 |

OTHER PUBLICATIONS

M. Lindmayer, M. Schubert; "Current Limitation by High Temperature Superconductors and by Conducting Polymers", no date.

Mark H. McKinney, Charles W. Brice and Roger A. Dougal; Polymer Current Limiters for Low–voltage Power Distribution Systems; pp. 1–8; 1997, no month.

Jorgen Skindhoj, Joachim Glatz–Reichenbach, Ralf Strumpler; Repetitive Current Limiter based on Polymer PCT Resistor; pp. 1–6; 1997; IEEE , no month.

C.W. Brice, R.A. Dougal and J.L. Hudgins; Review of Technologies for Current–Limiting Low–voltage Circuit Breaker; pp. 41–47; 1995; IEEE, no month.

C.B. Shao and J.G. Zhang; "Electric Contact Behavior of CU–SN Intermetallic Compound Formed in Tin Platings" pp. 26–33, 3/98; IEEE.

A. Duggal, F. Sun and L. Levinson; "High Power Current Limiting with Conductor–Filled Polymer Composites"; pp. 75–81; 3/98; IEEE.

William W. Chen; "A New Approach to Suppress Arcing in Current Interruption" pp. 87–92; 3/98; IEEE.

* cited by examiner

METHOD FOR INTERRUPTING A CURRENT-CARRYING PATH

CROSS-REFERENCE TO RELATED APPLICATIONS

This application is a continuation-in-part of application Ser. No.09/219,726 filed on Dec. 22, 1998.

BACKGROUND OF THE INVENTION

1. Field of the Invention

The present invention relates generally to the field of electrical circuit interrupting devices adapted to complete and interrupt electrical current carrying paths between a source of electrical power and a load. More particularly, the invention relates to a novel technique for rapidly interrupting an electrical circuit and for dissipating energy in a circuit interrupter upon interruption of a current carrying path.

2. Description of the Related Art

A great number of applications exist for circuit interrupting devices which selectively complete and interrupt current carrying paths between a source of electrical power and a load. In most conventional devices of this type, such as circuit breakers, a movable member carries a contact and is biased into a normal operating position against a stationary member which carries a similar contact. A current carrying path is thereby defined between the movable and stationary members. Such devices may be configured as single-phase structures, or may include several parallel mechanisms, such as for use in three-phase circuits.

Actuating assemblies in circuit interrupters have been developed to provide for extremely rapid circuit interruption in response to overload conditions, over current conditions, heating, and other interrupt-triggering events. A variety of such triggering mechanisms are known. For example, in conventional circuit breakers, bi-metallic structures may be employed in conjunction with toggling mechanisms to rapidly displace the movable contacts from the stationary contacts upon sufficient differential heating between the bi-metallic members. Electromechanical operator structures are also known which may initiate displacement of a movable contact member upon the application of sufficient current to the operator. These may also be used in conjunction with rapid-response mechanical structures such as toggle mechanisms, to increase the rapidity of the interrupter response.

In such circuit interrupters, a general goal is to interrupt at current close to zero as rapidly as possible. Certain conventional structures have made use of natural zero crossings in the input power source to effectively interrupt the current through the interrupter device. However, the total let-through energy in such devices may be entirely unacceptable in many applications and can lead to excessive heating or failure of the device or damage to devices coupled downstream from the interrupter in a power distribution circuit. Other techniques have been devised which force the current through the interrupter to a zero level more rapidly. In one known device, for example, a light-weight conductive spanner is displaced extremely rapidly under the influence of an electromagnetic field generated by a core and winding arrangement. The rapid displacement of the spanner causes significant investment in the expanding arcs and effectively extinguishes the arcs through the intermediary of a stack of conductive splitter plates. A device of this type is described in U.S. Pat. No. 5,587,861, issued on Dec. 24, 1996 to Wieloch et al.

While currently known devices are generally successful at interrupting current upon demand, further improvement is still needed. For example, in devices that do not depend upon a natural zero crossing in the incoming power, back-EMF is generally relied upon to extinguish the arcs generated upon opening, which, themselves, define a transient current carrying path. The provision of spaced-apart splitter plates establishes a portion of this transient current carrying path and represents resistance to flow of the transient current, producing needed back-EMF. However, depending upon the level of power applied to the device, such sources of back-EMF may be insufficient to provide sufficient resistance to current flow to limit the let-through energy to desired levels. In particular, splitter plates, as one of the sources of back-EMF, may fail at higher voltage levels (current tending to shunt around the plates, for example), imposing a limitation to the back-EMN achievable by conventional structures. As a result, depending upon the nature of the event triggering the circuit interruption, the excessive let through energy can degrade or even render inoperative the interrupter device.

There is a need, therefore, for an improved circuit interrupting technique which can provide efficient current carrying capabilities during normal operation, and which can rapidly interrupt current carrying paths, while limiting let through energy to reduced levels by virtue of rapid arc extinction. There is a particular need for a method that can be employed economically in a variety of interrupter structures while providing improved circuit interruption characteristics over a range of voltage and current ratings.

SUMMARY OF THE INVENTION

The invention provides a novel technique for interrupting an electrical current carrying path and for dissipating energy in a circuit interrupter designed to respond to these needs. The technique may be employed in a wide variety of circuit interrupting devices, such as circuit breakers, motor controllers, switch gear, and so forth. While the method is particularly well suited to very fast-acting devices, such as devices employing light-weight spanners or movable contacts structures, it may be used to improve circuit interruption of other interrupter types, including devices having various triggering mechanisms to initiate circuit interruption.

In accordance with the technique, a normal or first current carrying path is defined in an interrupter, along with a transient or alternative current carrying path. The transient current carrying path includes circuit components which establish a parallel current path during circuit interruption, and which change a conductive state to enhance the energy-dissipating capabilities of the transient circuit. In a preferred configuration, variable resistive structures are positioned adjacent to incoming and outgoing conductors, and are in a relatively conductive state during the initial phase of circuit interruption. Prior to interruption, the transient current carrying path may be an essentially open circuit, passing substantially no current, with all current being directed through the normal current carrying path. During interruption, arcs are created in parallel with the variable resistance elements. The energy of the circuit interruption is dissipated by both the arcs of the normal current carrying path, and by the resistance of the transient current carrying path. A rapid change in the resistive state of the elements then ensues, such as due to heating by the transient current. Thereafter, the elements contribute to the rapid interruption of the transient currents by contributing to the back EMF through the device. The elements which establish the preferred current carrying path, and which then change their resistive state, may be static components, such as a polymer in which a dispersion of conductive material is doped.

BRIEF DESCRIPTION OF THE DRAWINGS

The foregoing and other advantages of the invention will become apparent upon reading the following detailed description and upon reference to the drawings in which.

DETAILED DESCRIPTION OF SPECIFIC EMBODIMENTS

Figure 1:
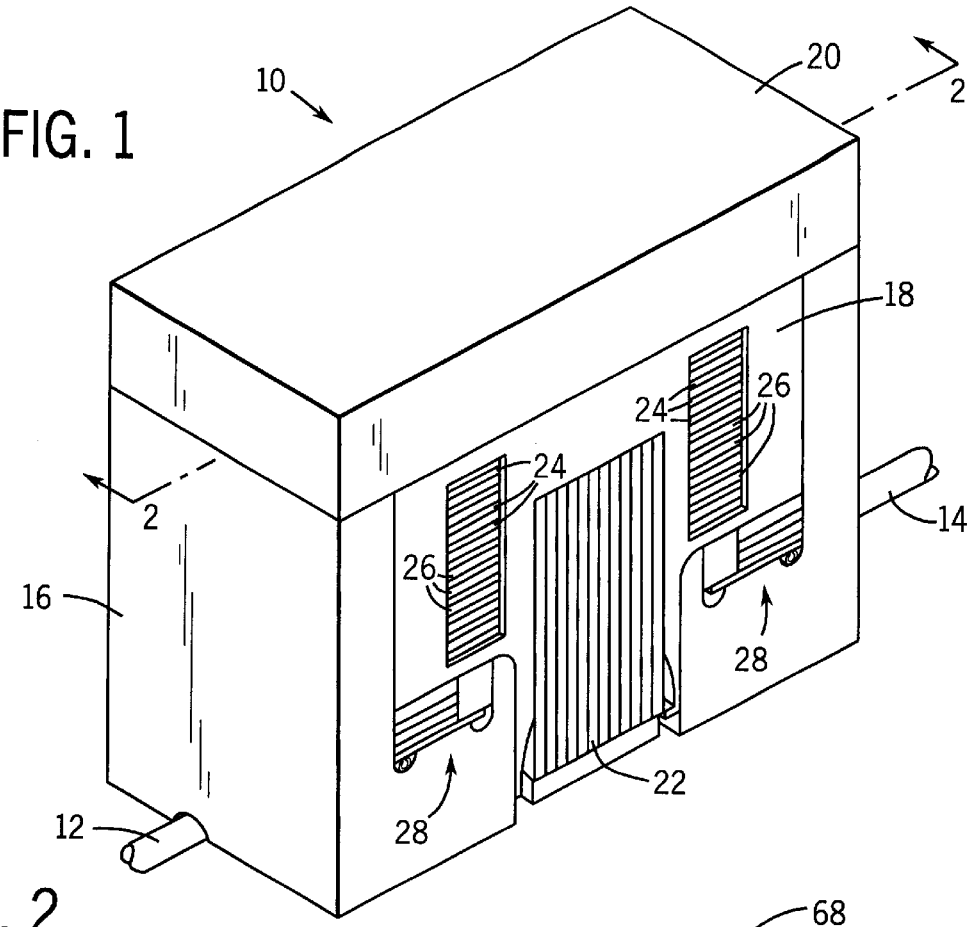
FIG. 1 is a perspective view of a circuit interrupter in accordance with the present technique for selectively interrupting an electrical current carrying path between a load and a source.

Turning now to the drawings, and referring first to FIG. 1, a modular circuit interrupter is represented and designated generally by the reference numeral 10. The circuit interrupter is designed to be coupled to an incoming or source conductor 12 and to an outgoing or load conductor 14, and to selectively complete and interrupt current carrying paths between the conductors. The interrupter module as illustrated in FIG. 1 generally includes an outer housing 16 and an inner housing 18 in which the functional components of the module are disposed as described in greater detail below. Outer housing 16 is covered by a cap 20.

It should be noted that the circuit interrupter module 10, shown in FIG. 1, is subject to various adaptations for incorporation into a wide variety of devices. For example, the interrupter module, and variants on the structure described below, may be incorporated into single phase or multi-phase interrupting devices such as circuit breakers, motor protectors, contactors, and so on. Accordingly, the module may be associated with a variety of triggering devices for initiating interruption, as well as with devices for preventing closure of the current carrying path following interruption. A range of such devices are well known in the art and may be adapted to function in cooperation with the module in accordance with the techniques described herein. Similarly, while in the embodiment described below a movable conductive element in the form of a spanner extends between a pair of stationary conductive elements or contacts, adaptations to the structure may include a movable element which contacts a single stationary element, or multiple movable elements which contact one another.

Returning to FIG. 1, also visible in this view is an interrupt initiator assembly, designated generally by the reference numeral 22. As described below, in the illustrated embodiment the initiator assembly causes initial interruption of a normal or first current carrying path through the device under the influence of an electromagnetic field. On either side of the interrupter assembly a series of splitter plates 24 are positioned and separated from one another by air gaps 26. Below each stack of splitter plates, a variable or controllable resistance assembly 28 is positioned for directing current through an alternative current carrying path during interruption of the normal current carrying path, and for aiding in rapidly causing complete interruption of current through the device.

Figure 2:
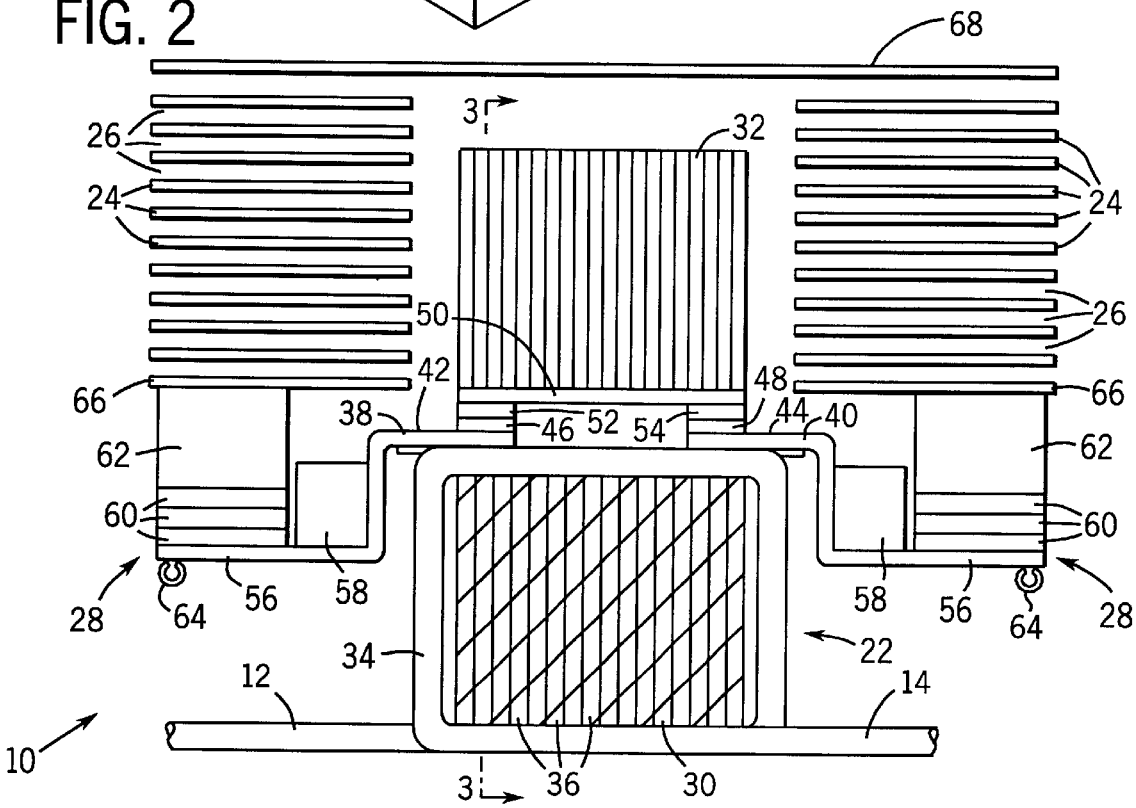
FIG. 2 is a sectional view through the assembly of FIG. 1, illustrating functional components of the assembly in a normal or biased position wherein a first current carrying path is established between the source and load.
Figure 3:
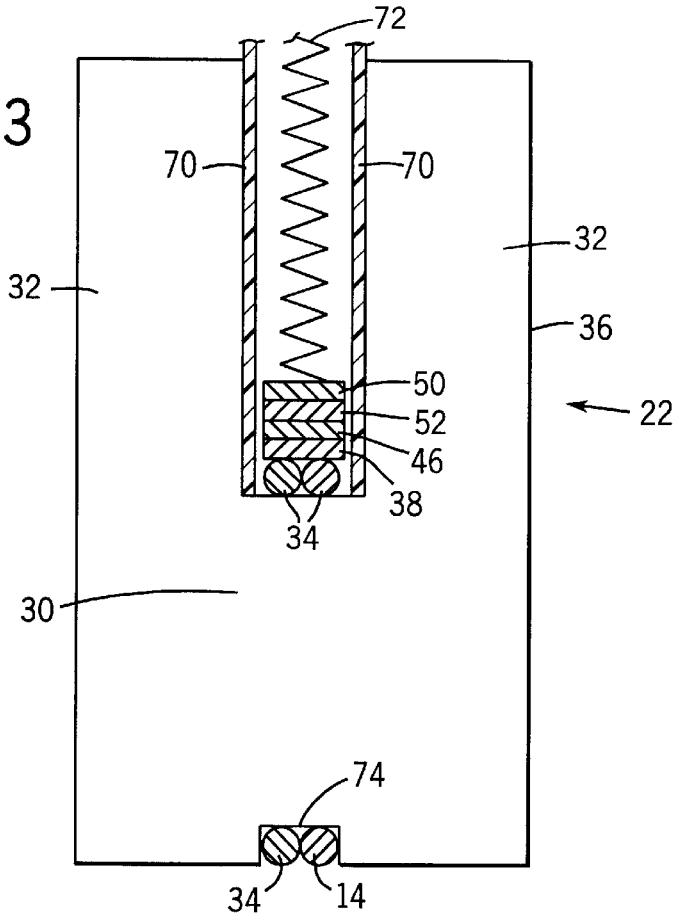
FIG. 3 is a transverse sectional view through a portion of the device of FIG. 1, illustrating the position of a movable conductive element in the device adjacent to a stationary conductive element.

FIG. 2 represents a longitudinal section through the device shown in FIG. 1. As illustrated in FIG. 2, initiator assembly 22 is formed of a unitary core having a lower core portion 30 and an upper core portion 32. Lower core portion 30 extends generally through the device, while upper core portion 32 includes a pair of upwardly-projecting elements or panels extending from the lower core portion 30. These upwardly-projecting elements are best illustrated in FIG. 3. In the illustrated embodiment, one of the conductors, such as conductor 14, is wrapped around lower core portion 30 to form at least one turn 34 around the lower core portion, as illustrated in FIG. 2. The turn or wrap around the core enhances an electromagnetic field generated during overload, overcurrent, and other interrupt-triggering events for initiating interruption. Lower and upper core portions 30 and 32 are preferably formed of a series of conductive plates 36 stacked and bound to one another to form a unitary structure. The individual plates in the core may be separated at desired locations by insulating members (not shown).

Conductors 12 and 14 are electrically coupled to respective stationary conductors 38 and 40 on either side of the initiator assembly. A variety of connection structures may be employed, such as bonding, soldering, and so forth. Each stationary conductor includes an upper surface which forms an arc runner, indicated respectively by reference numerals 42 and 44 in FIG. 2. Stationary contacts 46 and 48 are bonded to each stationary conductor 38 and 40, respectively, adjacent to the arc runners. In the embodiment illustrated in the Figures, the stationary conductors, the arc runners, and the stationary contacts are therefore at the electrical potential of the respective conductor to which they are coupled. A movable conductive element or spanner 50 extends between the stationary conductors and carries a pair of movable contacts 52 and 54. In a normal or biased position, the movable conductive spanner is urged into contact with the stationary conductors to bring the stationary and movable contacts into physical contact with one another and thereby to complete the normal or first current carrying path through the device.

Each stationary conductor 38 and 40 extends from the arc runner to form a lateral extension 56. Each extension 56 is electrically coupled to a respective variable resistance assembly 28 to establish a portion of the alternative current carrying path through the device. In the illustrated embodiment, each variable resistance assembly includes a spacer 58, a series of variable or controllable resistance elements 60, a conductor block 62, a biasing member 64, and a conductive member 66. The presently preferred structure and operation of these components of the assemblies will be described in greater detail below. In general, however, each assembly offers an alternative path for electrical current during interruption of the normal current carrying path, and permits rapid interruption of all current through the device by transition of resistance characteristics of the alternative path. Splitter plates 24, separated by air gaps 26, are positioned above conductive member 66, and a conductive shunt plate 68 extends between the stacks of splitter plates.

Certain of the foregoing elements are illustrated in the transverse sectional view of FIG. 3. As shown in FIG. 3, the plates 36 of the lower and upper core portions 30 and 32 form a generally H-shaped structure. An insulating liner 70 may extend between the upper core portions 32 and turns 34, and the stationary and movable contacts, to protect the core and turns from the arc. Liner 70 may include an extension of an internal peripheral wall of inner housing 18 shown in FIG. 1. A biasing member, such as a compression spring 72, is provided for urging the movable conductive spanner 50 into its normal or biased engaged position to complete the normal current carrying path. As mentioned above, in this orientation, movable and stationary contacts (see contacts 54 and 48 in FIG. 3) are physically joined to complete the normal current carrying path. In the illustrated embodiment lower core portion 30 also forms a trough 74 in which conductor 14 and at least one extension of turn 34 of the conductor are disposed.

The foregoing functional components of interrupter module 10 may be formed of any suitable material. For example, plates 36 of the core portions may be formed of a ferromagnetic material, such as steel. Stationary conductors 38 and 40 may be formed of a conductive material such as copper, and may be plated in desired locations. Similarly, movable conductive element 50 is made of an electrically conductive material such as copper. The stationary and movable contacts provided on the stationary and movable conductive elements are also made of a conductive material, preferably a material which provides some resistance to degradation during opening and closing of the device. For example, the contacts may be made of a durable material such as copper-tungsten alloy bonded to the respective conductive element. Finally, conductive members 66, splitter plates 24 and shunt plate 68 may be made of any suitable electrically conductive material, such as steel.

Figure 4:
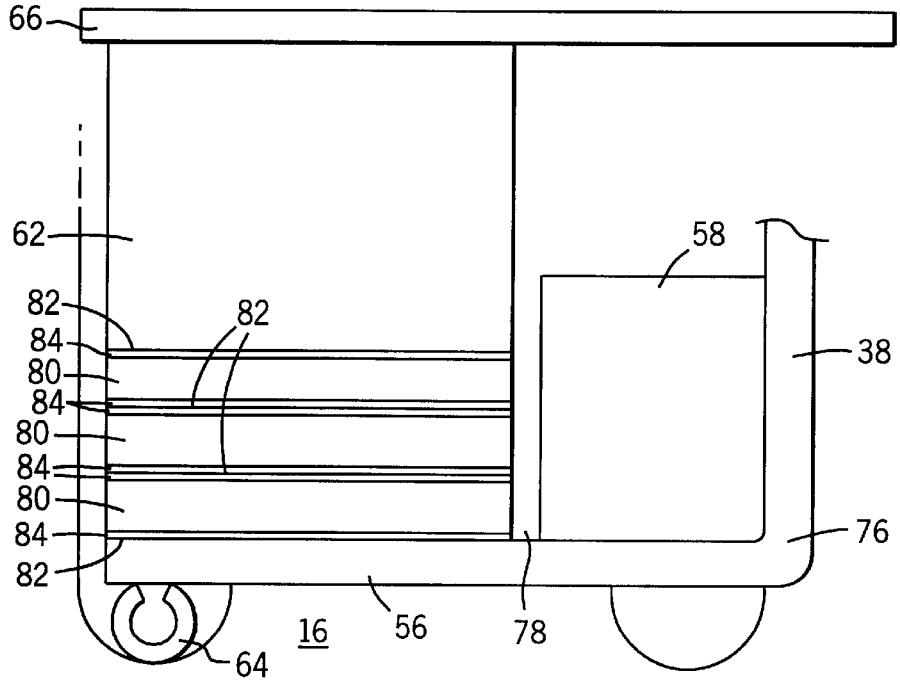
FIG. 4 is an enlarged detailed view of a portion of the device as shown in FIG. 2, including a variable resistance assembly for aiding in interrupting current through the device in accordance with certain aspects of the present technique.

The components of the variable resistance assemblies 28 are illustrated in greater detail in FIG. 4. In the illustrated embodiment, each stationary conductor, such as stationary conductor 38, includes a lower corner 76 formed between the arc runner (see FIG. 2) and the lateral extension 56. The lateral extension is generally supported by the inner housing 16. One or more variable resistance elements 60 are electrically coupled between each extension 56 and a respective conductive member 66, through the intermediary of a conductor block 62, if necessary. That is, where the spacing in the device requires electrical continuity to be assisted by such a conductive member, one is provided. Alternative configurations may be envisaged, however, where a conductor block 62 is not needed and electrical continuity between the stationary conductor and conductive member 66 is provided by the variable resistance elements alone. Moreover, in the illustrated embodiment, spacer 58, which is made of a non-conductive material, is positioned within the lower corner 76 between the lateral extension and a side or end surface of the variable resistance elements. In general, such spacers may be positioned in the device to reduce free volumes 78, or to change the geometry of such volumes, and thereby to limit or direct flow of gasses and plasma in the device during interruption. Again, where the geometry of the device sufficiently controls such gas or plasma flow, spacers of this type may be eliminated.

Electrical continuity between extensions 56 and conductive members 60 is further enhanced by biasing member 64. A variety of such biasing members may be envisaged. In the illustrated embodiment, however, the biasing member consists of a roll pin positioned between a lower face of lateral extension 56 and a trough formed in the inner housing. The biasing member forces the extension upwardly, thereby insuring good electrical connection between the extension, the variable resistance elements, and conductive member 66.

In the illustrated embodiment, a group of three variable resistance elements is disposed on either side of the initiator assembly. The variable resistance elements are electrically coupled to one another in series, and the groups of elements form a portion of the transient or alternative current carrying path through the device as discussed below. Depending upon the desired resistance in each of these assemblies, more or fewer such elements may be employed. Moreover, various types of elements 60 may be used for implementing the present technique. In the illustrated embodiment, each element 60 comprises a conductive polymer such as polyethylene doped with a dispersion of carbon black. Such materials are commercially available in various forms, such as from Raychem of Menlo Park, Calif., under the designation PolySwitch. In the illustrated embodiment, each of the series of three such elements has a thickness of approximately 1 mm. and contact surface dimensions of approximately 8 mm.×8 mm. In addition, to provide good termination and electrical continuity between the series of elements 60, each element body 80 may be covered on its respective faces 82 by a conductive terminal layer 84. Terminal layer 84 may be formed of any of a variety of materials, such as copper. Moreover, such terminal layers may be bonded to the faces of the element body by any suitable process, such as by electroplating.

While the conductive polymer material mentioned above is presently preferred, other suitable materials may be employed in the variable resistance structures in accordance with the present technique. Such materials may include metallic and ceramic materials, such as $BaTiO_3$ ceramics and so forth. In general, variable resistance elements such as elements 60 change their resistance or resistive state during operation from a relatively low resistance level to a relatively high resistance level. Commercially available materials, for example, change state in a relatively narrow band of operating temperatures, and are thus sometimes referred to as positive temperature coefficient (PTC) resistors. By way of example, such materials may increase their resistivity from on the order of 10 mΩcm at room temperature to on the order of 10 MΩcm at 120°–130° C. In the illustrated embodiment, for example, each element transitions during interruption of the device from a resistance of approximately less than 1 mΩ to a resistance of approximately 100 mΩ.

The voltage provided by these elements during fault interruption is a function of time that also depends on external circuit parameters which may vary. For example, under a typical 480 volt AC, 5 kA available conditions with 70% power factor, each element generates a back-EMF that rises smoothly from zero to approximately 12 volts at 1.5 ms after fault initiation and holds relatively constant thereafter until the fault current is terminated. As discussed more fully below, in the present technique, the elements do not pass current during normal operation, that is, as current is passed through a normal current carrying path in the device. Thus, during normal operation the elements do not offer voltage drop with normal load currents.

Figure 5:
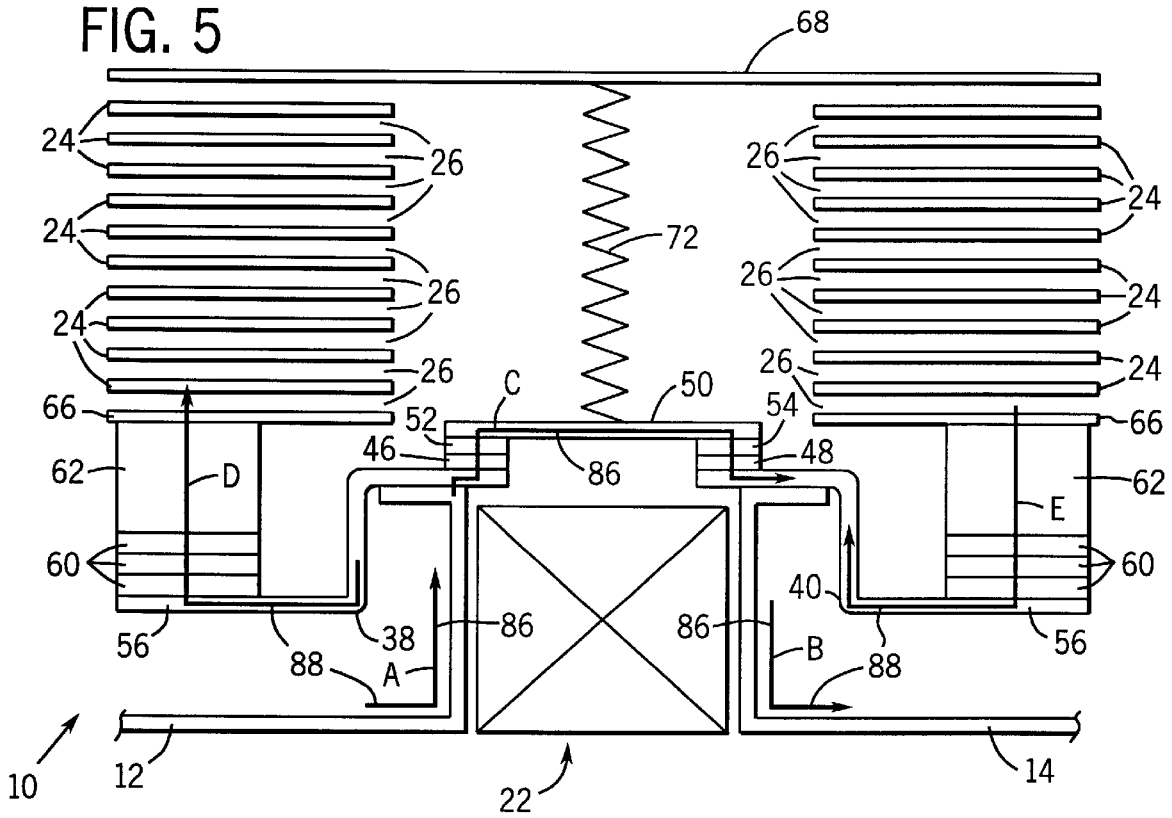
FIG. 5 is a diagrammatical representation of certain functional components illustrated in the previous figures, showing a normal or first current carrying path through the device as well as a transient or alternative current carrying path through the variable-resistance structures.
Figure 6:
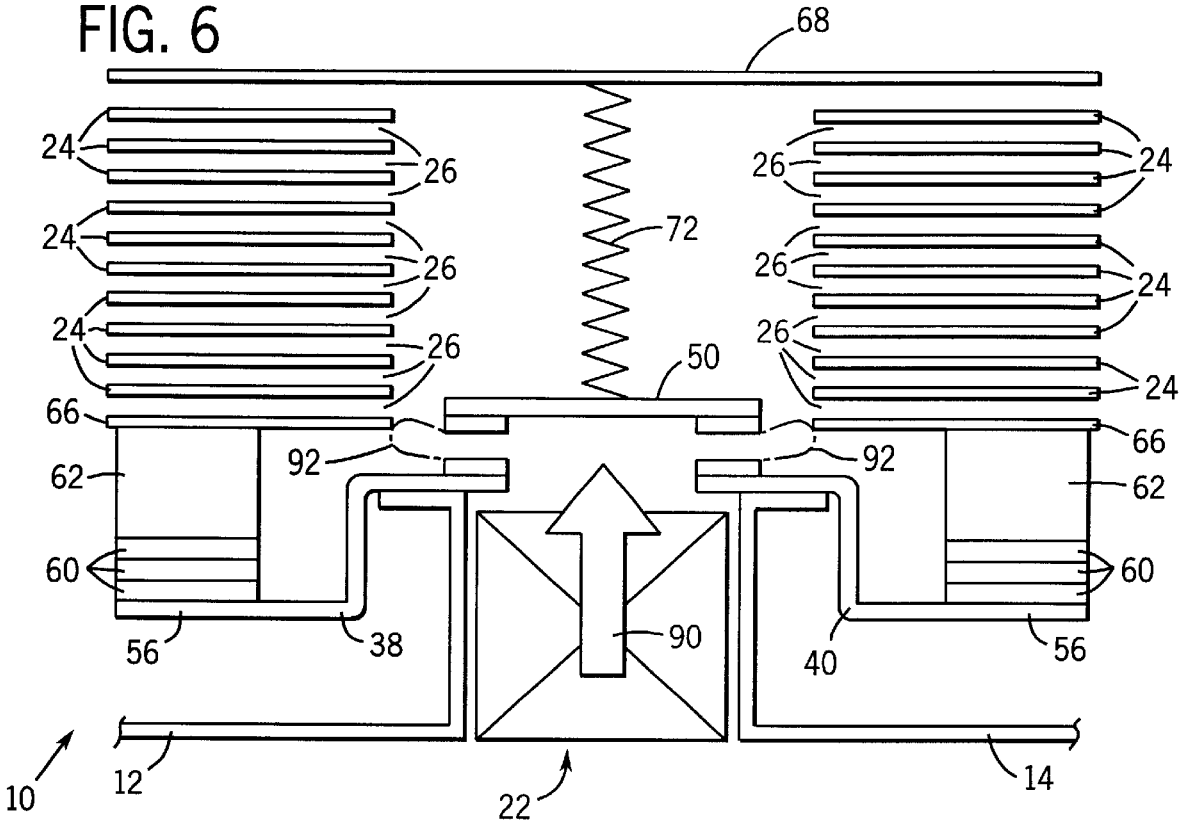
FIG. 6 is a diagrammatical representation of the functional components shown in FIG. 5 during a first phase of interruption of the normal current carrying path through the device.
Figure 7:
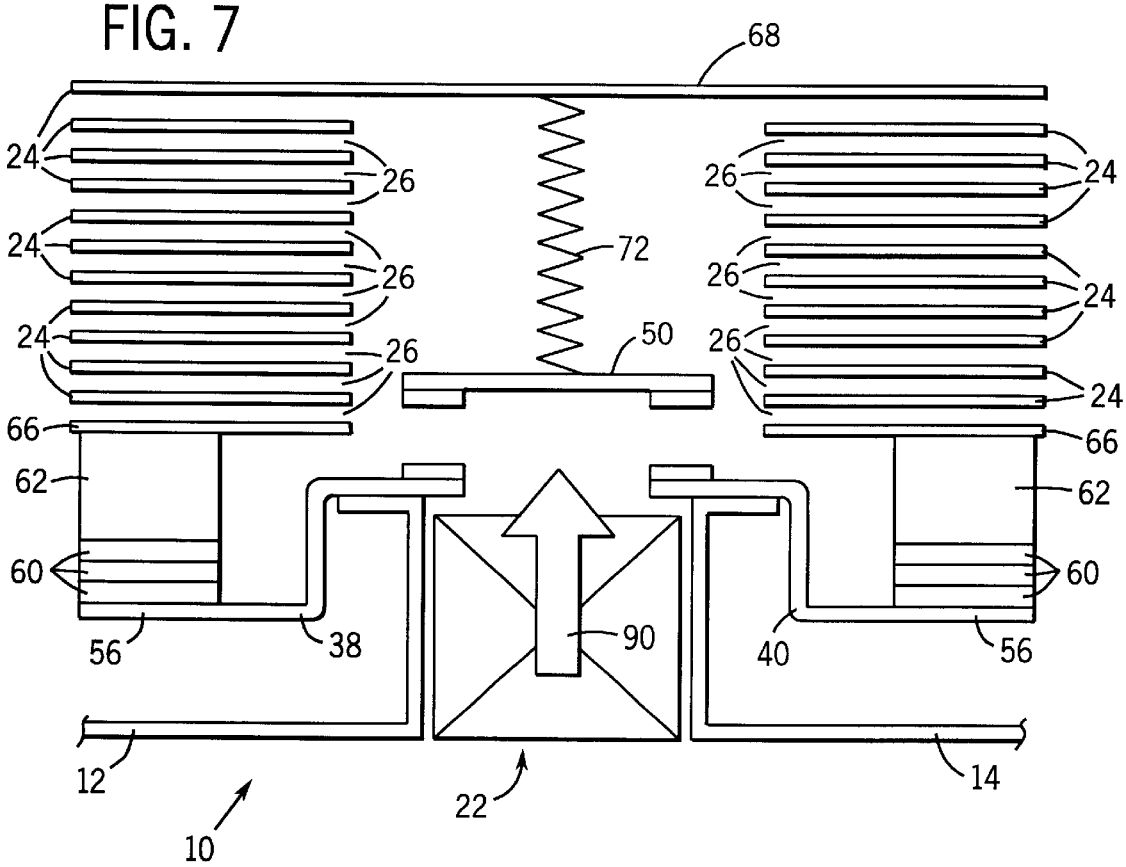
FIG. 7 is a diagrammatical representation of the functional components shown in FIG. 6 at a subsequent stage of interruption.

FIGS. 5, 6 and 7 illustrate current carrying paths through the device described above, both prior to and during interruption. As illustrated diagrammatically in FIG. 5, a normal or first current carrying path through the device, represented generally by reference numeral 86, includes segments A, B and C. Segment A includes conductor 12 extending up to and partially through stationary conductor 38. Similarly, section B includes conductor 14 and a portion of stationary conductor 40. It should be noted that the turn around the interrupt initiator assembly described above is not illustrated in FIGS. 5, 6 and 7 for the sake of simplicity. Section C of the normal current carrying path 86 is established by the stationary conductors 38 and 40, by movable conductive spanner 50, and the stationary and movable contacts disposed therebetween. Thus, during normal operation, current may flow freely between the source and load. The normal current carrying path is maintained by biasing of the movable conductive spanner against the stationary conductors.

A transient or alternative current carrying path is defined through the variable resistance assemblies described above. As illustrated in FIG. 5, this transient current carrying path, designated generally by the reference numeral 88, includes section A described above, as well as a section D extending through the extension 56 of stationary conductor 38, the variable resistance elements 60 associated therewith, the conductor block 62, if provided, and conductive member 66. The transient current carrying path then extends through the series of air gaps and splitter plates, and therefrom through shunt plate 68. Moreover, the transient current carrying path also is defined by section B described above, through conductor 14, and through extension 56 of stationary conductor 40, as well as through the variable resistance elements, conductor block and conductive member 66 associated therewith, as indicated by the letter E in FIG. 5. Thus, the alternative or transient current carrying path through the device extends between the source and load conductors, through the variable resistance assemblies, the splitter plates, air gaps, and shunt plate, these various components being electrically connected in series. It should be noted, however, that during normal operation, the resistance offered by the transient current carrying path, particularly by the air gaps between the splitter plates, forms an open circuit preventing current flow through the transient current carrying path, and forcing all current through the device to be channeled via the normal current carrying path 86.

Referring now to FIGS. 6 and 7, interruption of current flow through the device is illustrated in subsequent phases. From the normal or biased position of FIG. 5, interruption is initiated as shown in FIG. 6 by repulsion of the conductive spanner 50 from the stationary conductors or by any other suitable interrupt initiator. In the illustrated embodiment, this repulsion results from a strong electromagnetic field generated by the initiator assembly. As the conductive spanner 50 is moved from its normal or biased position, as indicated by arrow 90 in FIG. 6, arcs 92 form between the movable and stationary contacts of the spanner and stationary conductors. These arcs migrate from the contacts outwardly along the arc runners and contact conductive members 66 of each variable resistance assembly. At this initial phase of interruption, variable resistance elements 60 are placed electrically in parallel with a respective arc 92 and, following sufficient movement of the conductive spanner, offer a resistance to current flow between a respective stationary conductor and conductive member 66 to draw current into the alternative current carrying path. Current flow then transitions to both current carrying paths. As illustrated in FIG. 7, further movement of the conductive spanner may then proceed with complete interruption of the normal and alternative current carrying paths.

The interruption sequence described above is illustrated schematically in FIGS. 8*a*–8*e* through equivalent circuit diagrams. As shown first in FIG. 8*a*, with conductive spanner 50 in its biased position, the normal current carrying path is establish between conductors 12 and 14. The variable resistance assemblies, represented by variable resistors 96 in FIG. 8*a*, in combination with air gaps between conductive members 66 and splitter plates 24, represented by resistors 98 in the Figure, offer sufficient resistance to current flow to establish an open circuit through the transient current carrying path.

Figure 8A:
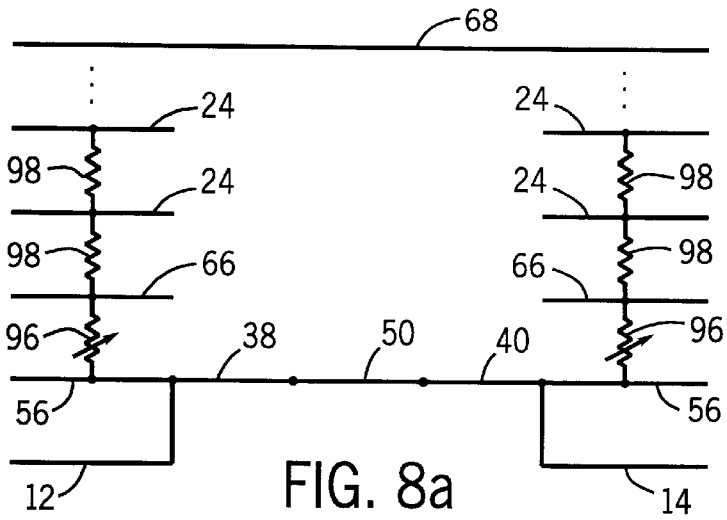
FIGS. 8*a*, 8*b*, 8*c*, 8*d* and 8*e* are schematic diagrams of equivalent circuits for the device in the stages of operation shown in FIGS. 5, 6 and 7.
Figure 8B:
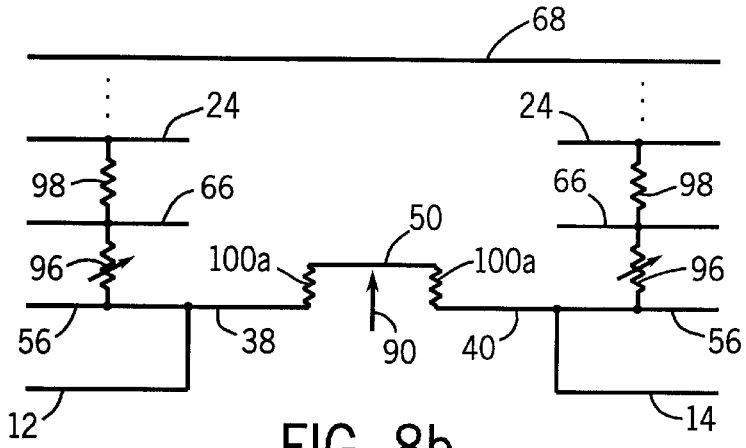
Figure 8C:
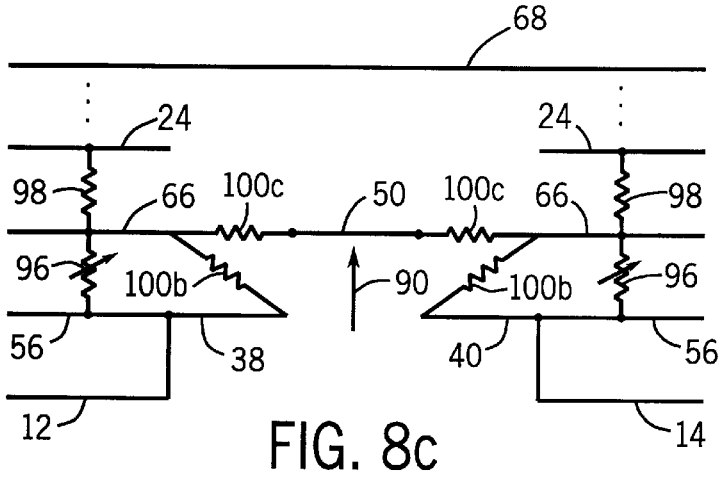

Upon initial interruption of the normal current carrying path, arcs established between the movable and stationary conductive elements define resistances 100*a* between the stationary conductors and spanner 50 as shown in FIG. 8*b*. At this stage of operation, resistors 96 defined by the variable resistance assemblies, remain at their relatively low resistivity levels. Subsequently, a shown in FIG. 8*c*, expanding arcs established between the stationary conductors 38 and 40, and spanner 50, extend to contact conductive members 66, to establish equivalent resistances 100*b* and 100*c* on each side of the device. It will be noted that equivalent resistances 100*b* established by the arcs are electrically in parallel with variable resistors 96. When the resistance offered by these assemblies, balanced with the resistance offered by the expanding and migrating arcs, favors transfer of a portion of the current flow through the transient current carrying path, the transient current carrying path begins conducting current through the device, in conjunction with the arcs.

Figure 8D:
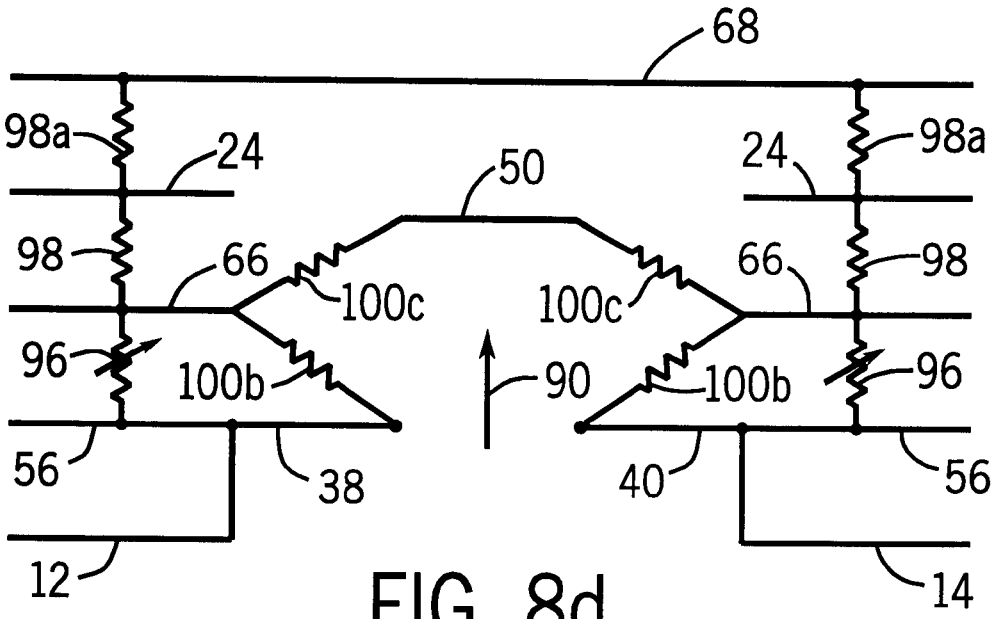
Figure 8E:
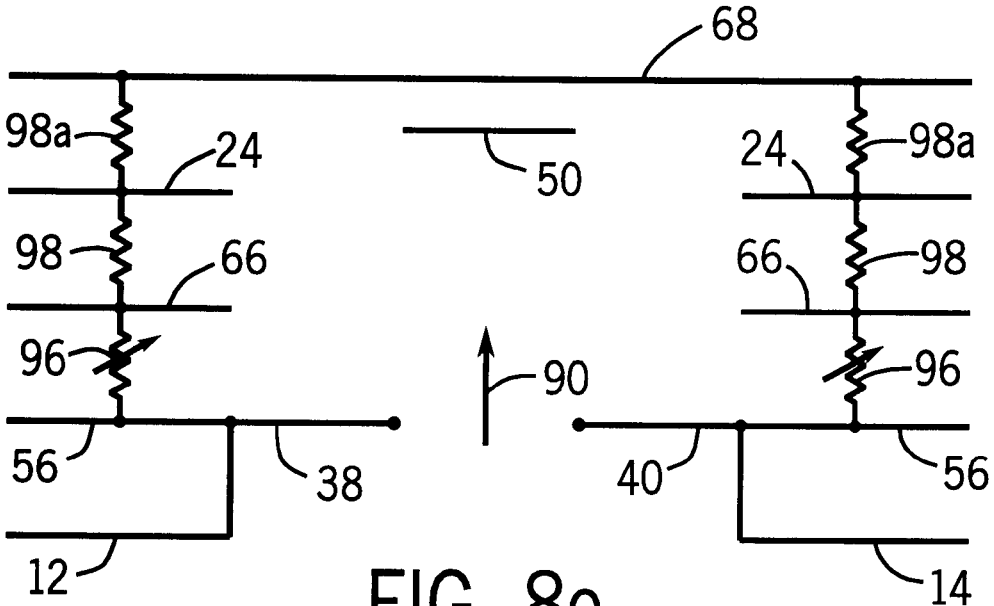

In a subsequent phase of interruption, illustrated schematically in FIG. 8*d*, current flows through both the normal and the transient current carrying paths. During this intermediate stage of interruption, the transient current carrying path extends through the variable resistors 96, through arcs 100*c* and through spanner 50, as well as through resistances 98, and shunt plate 68. These parallel current carrying paths eventually terminate current flow, with current flow terminating through the spanner 50 upon extinction of arcs 100*b* and 100*c*. Such termination of current flow through the normal current carrying path (established by arcs 100*b*) may occur before termination of current through the transient path. As the spanner is displaced further in its movement, as indicated by arrow 90, interruption is eventually completed, terminating all current flow through the device, as indicated in FIG. 8*e*.

With heating during these progressive phases of interruption, the variable resistance assemblies transition to their higher resistivity level. In the illustrated embodiment, for example, each variable resistance assembly provides, in the subsequent phase of interruption, a voltage drop of approximately 75 volts. Each air gap between the splitter plates, indicated at reference numeral 98 in FIGS. 8*a*, –8*e*, provides an additional 17 volts of back-EMF. A total back- EMF is provided in an exemplary structure, therefore, of approximately 900 volts, of which approximately 150 volts is provided by the variable resistance elements. It is believed that in the current structure, certain of the upper splitter plates and shunt plate 68 may contribute little additional back-EMF for interruption of current through the device. However, it is currently contemplated that one or more variable resistors comprising one or more layers of material, such as that defining assemblies 28, may be added at upper levels in the transient current-carrying path to provide additional assistance in establishing back-EMF and interrupting current flow.

Figure 9:
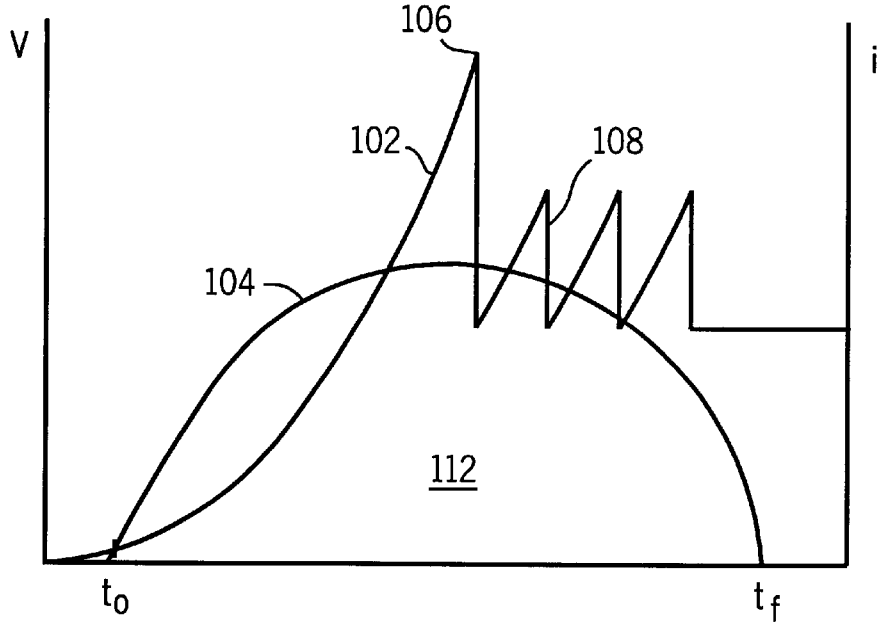
FIG. 9 is a graphical representation of voltage and current traces during interruption of an exemplary conventional circuit interrupter.
Figure 10:
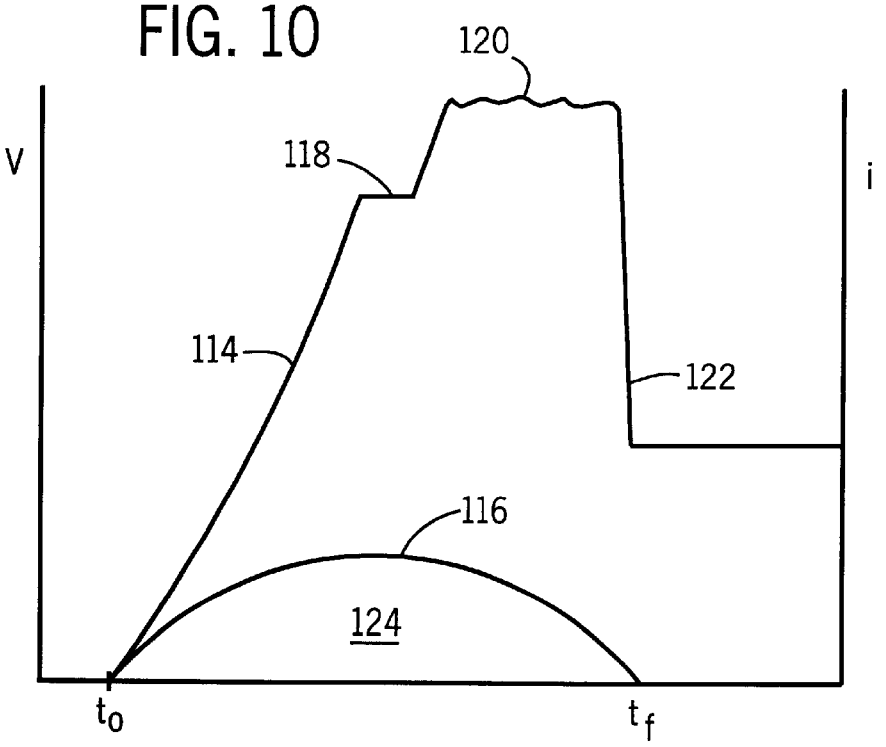
FIG. 10 is a graphical representation of exemplary voltage and current traces during interruption of a device in accordance with the present technique.

It has been found that the present technique offers superior circuit interruption, reducing times required for driving current to a zero level, and thereby substantially reducing let-through energy. Moreover, it has been found that the technique is particularly useful for high voltage (e.g. 480 volts) single phase applications. FIGS. 9 and 10 illustrate a contrast between the performance of conventional circuit interrupters and performance of the exemplary structure described above.

As shown in FIG. 9, where circuit interruption begins at a time $t_0$, a back-EMF voltage trace 102 in a conventional device rises sharply, as does a trace of current 104 through a splitter plate and shunt bar arrangement. The back-EMF voltage reaches a peak 106, then declines and oscillates as shown at reference numeral 108. In exemplary tests of a single phase device, with a 480 volt source, an available current of approximately 8,000 Amps, and a power factor of approximately 60%, a clearing time ($t_0$ to $t_f$) of approximately 3.8 ms was obtained. A peak back-EMF was realized at a level of approximately 913 volts. Let-through energy, represented generally at reference numeral 112 in FIG. 9 was approximately $10.7\times10^4 A^2s$.

As illustrated in FIG. 10, a back-EMF voltage trace 114 for an interrupter of the type described above exhibits a similar rise following initiation of interruption at time $t_0$ while a trace of current 116 rises significantly more slowly than in the conventional case. Moreover, the voltage trace reaches an initial level 118, followed by a further rise to a higher sustained peak, as indicated at reference numeral 120, before falling off with the decline of current to a zero level at time $t_f$, as indicated at reference numeral 122. In exemplary tests, with similar conditions to those set forth above, a clearing time of approximately 2.72 ms was obtained, with a peak back-EMF of 1010 volts. Let-through energy, represented generally at reference numeral 124, was approximately $7.60\times10^3 A^2s$.

The particular performance and let-through energy limiting features of the present technique will, of course, vary with the particular interrupter design, and the physics of the establishment of arcs and current paths in the device resulting from the design. For example, while in the foregoing discussion, description was based upon a light-weight movable spanner 50, more conventional devices may also benefit from the parallel current-carrying path established by virtue of the positioning of the variable resistance devices in the splitter plate stack, or in a similar location. Moreover, while the foregoing discussion was based upon a variable resistance device having a relatively sharp transition point between resistance states, more linearly-varying devices may be employed, such as carbon or graphite.

As regards the specific material selected for the variable resistance elements, it is believed that the surprisingly rapid extinction of arcs and the interruption of current in the present device may be optimized through behavior of the specific material. For example, fault current through the variable resistance elements may reduce the current through the parallel arc and the corresponding arc voltage may thereby be cause to increase owing to negative resistance characteristics of the arcs. Moreover, partial ablation of a surface of the variable resistance element may generate gas flow which tends to oppose the magnetically driven motion of the parallel arc into the splitter plate stack, again increasing its voltage by forcing higher investment of electrical energy to compensate for the loss of charged carriers (e.g., positive ions and free electrons). Moreover, gasses evolved during such ablation may be chemically active in promoting faster recombination of electrons and ions, having an effect equivalent to gas dynamically blowing the electrons and ions away from the arc path. However, it is believed that at least a portion of the benefits demonstrated with the foregoing structure and method may be obtained through the use of various resistance materials in the manner described.

In addition to establishing a transient or alternative current carrying path for rapidly interrupting current through the device as described above, the present technique serves to reduce or eliminate arc retrogression during interruption. As will be appreciated by those skilled in the art, arc retrogression is a common and problematic failure mode in circuit breakers and other circuit interrupters, particularly under high voltage, single-phase conditions. In this failure mode, parasitic arcs external to the splitter plate stack provide parallel paths to arcs within the splitter plate stacks. Arc retrogression is believed to be caused by residual ionization resulting from prior arcing, and from strong electric fields due to high back-EMF concentrations. When new arcs are initiated, back-EMF drops precipitously and older arcs in the splitter plate stack are extinguished as volt current transfers to the new lower voltage, lower resistance arc. The new arc then folds into the splitter plate stack, increasing its back-EMF until the retrogression threshold is reached again and the process is repeated, giving rise to a characteristic high frequency voltage oscillation. As a result of such oscillations, the average back-EMF through the successive retrogression cycles is lower than it would be without such cycles, prolonging the process of driving the current to a zero level, and permitting additional let-through energy.

Through the present technique, such retrogression is significantly reduced or eliminated. In particular, the use of the variable or controlled resistance material in the transient current carrying path, provides additional back-EMF, removing some of the load from the splitter plate stack which can then operate below the retrogression threshold and circumvent the retrogression-related voltage oscillations. The use of the material adjacent to the core in the preferred embodiment also redistributes the back-EMF within the device, shifting an additional portion of the back-EMF to a location adjacent the core where magnetic field density is greater and aids in opposing retrogression by raising its threshold.

As noted above, additional variable resistance material may be provided at elevated levels in the transient current carrying path. Such additional structures are believed to enable further-reduction in the occurrence of retrogression. In particular, prior to transition of the materials to an elevated resistance level, they provide a short circuit or lower resistance path, preventing the retrogression effects. Upon heating and transition to a higher resistance level, such structures would provide additional sources of back-EMF to assist in driving the fault current to a zero level. It is also noted that because a time delay is inherent in conversion of the additional structures from one resistance level to another by heating, such delays would permit residual ionization (associated with arc commutation to the splitter plates adjacent to such variable resistance structures) to decay somewhat before the electric field subsequently appears. As the level of residual ionization decreases, the electric field or voltage per unit length required to initiate retrogression increases. Thus, the delay in transition of the material to a higher resistance level permits a higher back-EMF to be eventually applied to more rapidly bring the fault current to a zero level without initiating unstable arc retrogression.

While the invention may be susceptible to various modifications and alternative forms, specific embodiments have been shown and described herein by way of example only. It should be understood that the invention is not intended to be limited to the particular forms disclosed. Rather, the invention is to cover all modifications, equivalents and alternatives falling within the spirit and scope of the invention as defined by the following appended claims. For example, those skilled in the art will readily recognize that the foregoing innovations may be incorporated into various forms of switching devices and circuit interrupters. Similarly, certain of the present teachings may be used in single-phase devices as well as multi-phase devices, and in devices having different numbers of poles, and various arrangements for initiating circuit interruption. Moreover, the present technique may be equally well employed in interrupters having a single movable contact element or multiple movable elements. As mentioned above, the variable resistance elements and assemblies may be placed in different locations of the transient current carrying path described, including in locations above the stationary conductors, such as adjacent to or in place of the shunt bar, for example.

What is claimed is:

1. A method for dissipating energy in a circuit interrupter, the method comprising the steps of:

(a) providing first and second current carrying paths electrically coupled in parallel between two conductors, the first current carrying path including a movable contact structure and the second current carrying path including a controllable resistive element electrically in series with and upstream of an open circuit section, the open circuit section including a plurality of spaced-apart conductors;

(b) closing the movable contact structure to direct electrical current through the first current carrying path and substantially no current through the second current carrying path;

(c) opening the movable contact structure to form an expanding arc;

(d) expanding the arc from the first current carrying path into contact with a conductor of the open circuit section electrically around the controllable resistive element to transfer a portion of the current flow through the second current carrying path through the controllable resistive element prior to through the open circuit section; and (e) transitioning a resistive state of the controllable resistive element from a first resistance to a second resistance higher than the first resistance;

wherein the first and second current carrying paths both conduct current at least during an initial phase of interruption.

2. The method of claim 1, wherein current through the first current carrying path is interrupted before current through the second current carrying path.

3. The method of claim 1, wherein step (b) includes urging a movable conductive element into contact with a stationary conductive element.

4. The method of claim 3, wherein step (c) includes displacing the movable conductive element under the influence of an interruption initiating device.

5. The method of claim 4, wherein the interruption initiating device includes an electromagnetic assembly positioned adjacent to the movable conductive element for displacing the movable conductive element via an electromagnetic field.

6. The method of claim 5, wherein the spaced-apart conductors are spaced from one another by respective air gaps.

7. The method of claim 1, wherein the current flow is transferred from the first current carrying path to the second current carrying path by providing a resistance to current flow through at least a portion of the second current carrying path less than a resistance to current flow through the first current carrying path.

8. The method of claim 1, wherein the spaced-apart conductors are energy dissipating members and wherein the second current carrying path includes the controllable resistive element electrically in series with the plurality of energy dissipating members.

9. The method of claim 1, wherein the controllable resistive element includes a plurality of variable resistive members coupled to one another electrically in series.

10. A method for interrupting electrical current through a circuit interrupter, the method comprising the steps of:

(a) defining a first current carrying path through the interrupter;

(b) defining a second current carrying path including a variable resistive element electrically in series with and upstream of an open circuit section, the second current carrying path being electrically in parallel with the first current carrying path, the open circuit section including a plurality of spaced-apart conductors;

(c) directing electrical current through the first current carrying path;

(d) opening the first current carrying path;

(e) directing electrical current through both the first and second current carrying paths during an initial phase of interruption through the variable resistive element prior to through the open current section; and (f) terminating electrical current through the first and second current carrying paths by combined resistances of the current carrying paths.

11. The method of claim 10, wherein resistance of the first current carrying path includes resistance of the arc between a movable contact and a stationary contact.

12. The method of claim 11, wherein resistance of the second current carrying path increases as current is directed through the second current carrying path.

13. The method of claim 10, including the further step of transitioning the variable resistive element from a first resistance to a second resistance higher than the first resistance.

14. The method of claim 10, wherein current through the first current carrying path is terminated before current through the second current carrying path.

15. The method of claim 10, wherein the second current carrying path includes a plurality of variable resistive elements electrically in series with one another.

16. The method of claim 10, wherein the variable resistive element is transitioned from the first resistance to the second resistance by heating.

17. A method for interrupting electrical current through an electrical device, the method comprising the steps of:

(a) directing substantially all of the electrical current through a first current carrying path within the device;

(b) initiating interruption of the first current carrying path during an initial phase of interruption;

(c) directing current through the first current carrying path and a second current carrying path in parallel with the first current carrying path during an intermediate phase of interruption, the second current carrying path including in series at least one variable resistance element, a plurality of conductive plates, and a plurality of air gaps downstream of the at least one variable resistance element, the current being directed through the at least one variable resistance element prior to through the plurality of air gaps; and (d) terminating current flow through the first and second current carrying paths in a final phase of interruption.

18. The method of claim 17, wherein the variable resistance element is disposed between a conductor of the first current carrying path and a conductive plate of the second current carrying path, and wherein current is drawn toward the second current carrying path in the intermediate phase of interruption by a comparatively lower resistance of the variable resistance element and an arc established in the first current carrying path.

19. The method of claim 18, wherein step (d) includes the step of increasing resistance of the second current carrying path.

20. The method of claim 18, wherein step (a) includes providing sufficient resistance to flow of electrical current through the second current carrying path to completely inhibit current flow through the second current carrying path.

21. The method of claim 18, wherein interruption of the first current carrying path is initiated by displacing a conductive contact member from a stationary contact member within the first current carrying path.

22. The method of claim 18, wherein in step (d) current is terminated through the first current carrying path before current is terminated through the second current carrying path.

23. The method of claim 18, wherein the resistance of the second current carrying path is increased by increasing the resistance of the variable resistance element of the second current carrying path.

24. The method of claim 18, wherein the second current carrying path includes a plurality of variable resistance elements electrically coupled to one another in series, the variable resistance elements transitioning between resistive states as a function of temperature during the intermediate phase of interruption.

* * * * *